US005469680A

United States Patent [19]

Hunt

[11] Patent Number: 5,469,680

[45] Date of Patent: Nov. 28, 1995

[54] METAL ROOFING SYSTEM

[75] Inventor: David L. Hunt, Westernville, N.Y.

[73] Assignee: Revere Copper Products, Inc., Rome, N.Y.

[21] Appl. No.: 210,379

[22] Filed: Mar. 18, 1994

[51] Int. Cl.[6] ..... F04D 1/00

[52] U.S. Cl. ..... 52/520; 52/543; 52/531; 52/539

[58] Field of Search ..... 52/520, 521, 531, 52/534, 536, 533, 539, 543–546

[56] References Cited

U.S. PATENT DOCUMENTS

| | | | |
|---|---|---|---|
| 1,887 | 12/1840 | Docker | 52/543 |
| 1,597,993 | 8/1926 | Meurer | 52/539 X |
| 1,665,774 | 4/1928 | Conway | 52/543 X |
| 2,685,852 | 8/1954 | Godel | 52/539 X |
| 3,380,214 | 4/1968 | Stevens | 52/545 X |
| 3,411,259 | 11/1968 | Anderson et al. . | |
| 3,977,145 | 8/1976 | Dobby et al. | 52/521 X |
| 4,010,590 | 3/1977 | Reinke | 52/533 X |
| 4,218,857 | 8/1980 | Vallee | 52/94 |
| 4,404,783 | 9/1983 | Freiborg | 52/518 |
| 4,424,655 | 1/1984 | Trostle | 52/547 X |
| 4,706,435 | 11/1987 | Stewart | 52/533 |
| 5,074,093 | 12/1991 | Meadows | 52/537 |
| 5,146,727 | 9/1992 | Hansson | 52/531 |
| 5,305,570 | 4/1994 | Rodriguez et al. | 52/536 X |
| 5,349,801 | 9/1994 | Verbofsky | 52/545 X |

*Primary Examiner*—Carl O. Friedman
*Assistant Examiner*—Winnie S. Yip
*Attorney, Agent, or Firm*—Harris Beach & Wilcox

[57] ABSTRACT

In a metal roofing system in which a plurality of overlapping horizontal courses of metal shingles are secured to a roofing substructure, each course being formed from a horizontal row of metal shingles that overlap and interlock with other metal shingles in a course disposed directly therebelow, and wherein a joint pan is positioned below abutting metal shingles within each course, the improvement comprising: a deformation at a top of each joint pan, the deformation indicating proper placement for a short edge of a metal shingle.

8 Claims, 4 Drawing Sheets

METAL ROOFING SYSTEM

BACKGROUND OF THE INVENTION

1. Field of the Invention

This invention relates to shingle-like metal sheets used for roofing and more particularly to an improved roofing system that allows speedy installation of metal, particularly copper that has been pre-formed into shingle-like sheets.

2. Description of the Prior Art

Due to its attributes, copper lends itself particularly well to use as a roofing material. Copper is extremely durable, being corrosion resistant and immune to most environmental forces as well as industrial based pollutants including acid rain. Copper roofing is so durable, that it may outlast the building upon which it is installed. Copper roofs are also essentially maintenance free; they do not need periodic cleaning, painting, sealing or the like. Dents and scratches ordinarily do not affect the life of copper; their effect on its appearance is generally temporary, because over time they tend to disappear as the copper ages from its original bright shine, through brown or bronze tones, and ultimately to its renowned green patina.

Copper is also noncombustible and light weight, weighing about half as much as composition shingles, one fourth as much as most tiles, and one eighth as much as quality slate.

Sheet metal copper roofing has been known and used for centuries, but was made costly by the difficulties of its installation. It is therefore desirable to provide a copper roofing system which can be installed rapidly and easily, thereby substantially reducing the cost of copper roofing, making it practicable for use in homes, small commercial buildings, and the like. The shingle-like metal sheets used in this type of system, whether fabricated of copper or of other practicable metals, will be hereinafter termed metal shingles.

The majority of prior art metal roofing systems have involved the use of long roofing panels which overlapped both vertically and horizontally in order to ensure that water was not able to reach the underlying structure. Usually these panels were designed so that successive runs of panels interlocked. Prior art patents that involve this type of construction include U.S. Pat. No. 5,146,727 to Hansson and U.S. Pat. No. 4,010,590 to Reinke. U.S. Pat. No. 4,218,857 to Vallee was for a roofing system involving a more complicated herringbone pattern laid above a base of pentagonal shingles.

In U.S. Pat. No. 3,411,259 to Anderson et al, assigned to a common assignee, there was taught a metal roofing system in which adjacent long panels abutted on their short, vertical edges rather than overlapping. Thus the long panels only overlapped in horizontal layers. A specially designed metal flashing pan (or joint pan) located underneath the abutting edges, protected the substructure from water and the like by collecting liquid and delivering it to the upper surface of the metal shingles of the horizontal row of shingles disposed directly therebelow. The teachings of the U.S. Pat. No. 3,411,259 patent to Anderson et al. are herein incorporated by reference as these teaching relate to a sheet metal roofing system wherein long courses of panels overlap in horizontal layers and abut vertically and wherein a joint plate is disposed beneath the abutting edges.

One advantage of the invention of Anderson et al. was that it provided the freedom to lay metal shingles over a previous row without having to start the process from a given position, as had to be done when overlapping vertically. This meant that an installer need not walk back to the beginning of each row, but could begin installation from where the prior row was completed. This saved time as well as limiting exposure to the problems caused by walking repeatedly across a partially completed roof. Another advantage is that this construction is resistant to high wind and other external forces of the kind that caused prior art metal shingle roofing to develop leaks.

It was desired, however, to improve upon this system by providing additional features. First, although the system could be installed more expeditiously than metal shingle roofs of the prior art, the positioning of successive rows of shingles required that the shingle installer snap chalk lines, measure and mark each shingle, or resort to other labor intensive techniques in order to attain proper alignment of the joints between shingles, the alignment and spacing of adjacent shingles, the alignment of singles with respect to those in the previous horizontal row, and the lap of shingles over the joint pan. The system of the instant invention obviates this problem by a combination of a deformation or ridge on the top of each joint pan and indicators along the upper securement border of the shingles. Proper placement and alignment of the shingles allows for maximal weatherproofing and allows room for naturally occurring expansion and contraction movement.

Second, in the earlier invention the installer received no guidance as to the proper spacing of fasteners in order to achieve maximum resistance to wind blow-off. Nor was there allowance for free expansion and contraction of the individual shingles such as might occur due to extremes in weather. Restriction at the fastener could, during shingle expansion, result in buckling or oil canning of the shingles.

In addition, the earlier invention did not use, as a part of the system, barbed copper nails as does the instant invention. The installer, left to his or her own devices, might use galvanically incompatible fasteners which could rust out or fasteners which did not possess sufficient resistance to withdrawal.

SUMMARY OF THE INVENTION

It is therefore a primary object of the present invention to provide an improved metal shingle roofing system.

It is a further object of this invention to provide an improved metal shingle roofing system that insures proper spacing of fasteners to achieve maximum resistance to wind blow-off.

It is still a further object of this invention to provide an improved metal shingle roofing system that allows free expansion and contraction of individual shingles.

It is yet a further object of this invention to provide an improved metal shingle roofing system that ensures proper alignment of abutting shingles.

It is yet another object of this invention to provide an improved metal shingle roofing system that ensures proper spacing and placement of the shingles to accommodate naturally occurring expansion.

It is still another object of this invention to provide an improved metal shingle roofing system that indicates proper placement of shingles and joint pans without the necessity of snapping chalk lines or measuring and marking.

It is yet a further object of this invention to provide an improved all copper metal shingle roofing system.

These and other objects of the present invention are attained by, in a metal roofing system in which a plurality of overlapping horizontal courses of metal shingles are secured to a roofing substructure, each course being formed from a horizontal row of metal shingles that overlap and interlock with other metal shingles in a course disposed directly therebelow, and wherein a joint pan is positioned below abutting metal shingles within each course, the improvement comprising: a deformation at a top of each joint pan, the deformation indicating proper placement for a short edge of a metal shingle.

BRIEF DESCRIPTION OF THE DRAWINGS

For a better understanding of these and other objects of the present invention, reference is made to the detailed description of the invention which is to be read in conjunction with the following Drawing, wherein.

DETAILED DESCRIPTION OF THE INVENTION

Figure 5:
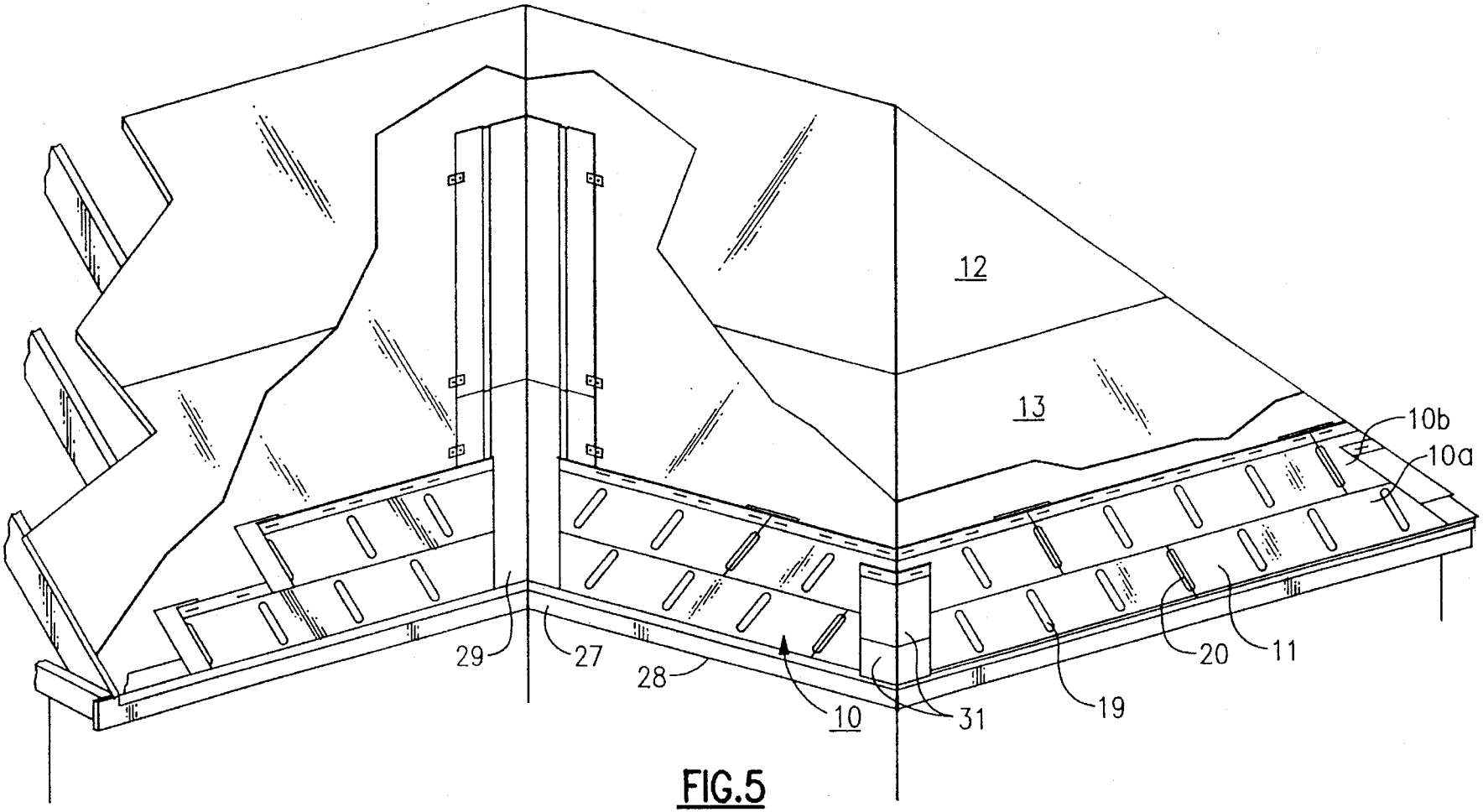
FIG. 5 is a fragmentary perspective view, partially broken away, of the roofing construction of the instant invention showing the ridge-like structure of two pitched roof sections.

Turning now to the Drawing and particularly FIG. 5 thereof, there is shown the general type of roofing construction, generally referenced 10, to which the instant invention relates. This construction comprises a plurality of horizontal rows or courses 10*a*, 10*b*, etc. of metal shingles 11 (preferably of copper, as will hereinafter be assumed), which overlap and interlock with the metal shingles 11 of the course disposed directly above and/or directly below. The metal shingles 11 are secured by nailing with roofing nails 35 or the like, preferably barbed copper roofing nails, to the roofing substructure which comprises, usually, a layer of wooden sheathing material 12 such as plywood or the like over which is placed a layer of waterproofing material 13 such as tarred roofing paper, felt or the like.

Figure 1A:
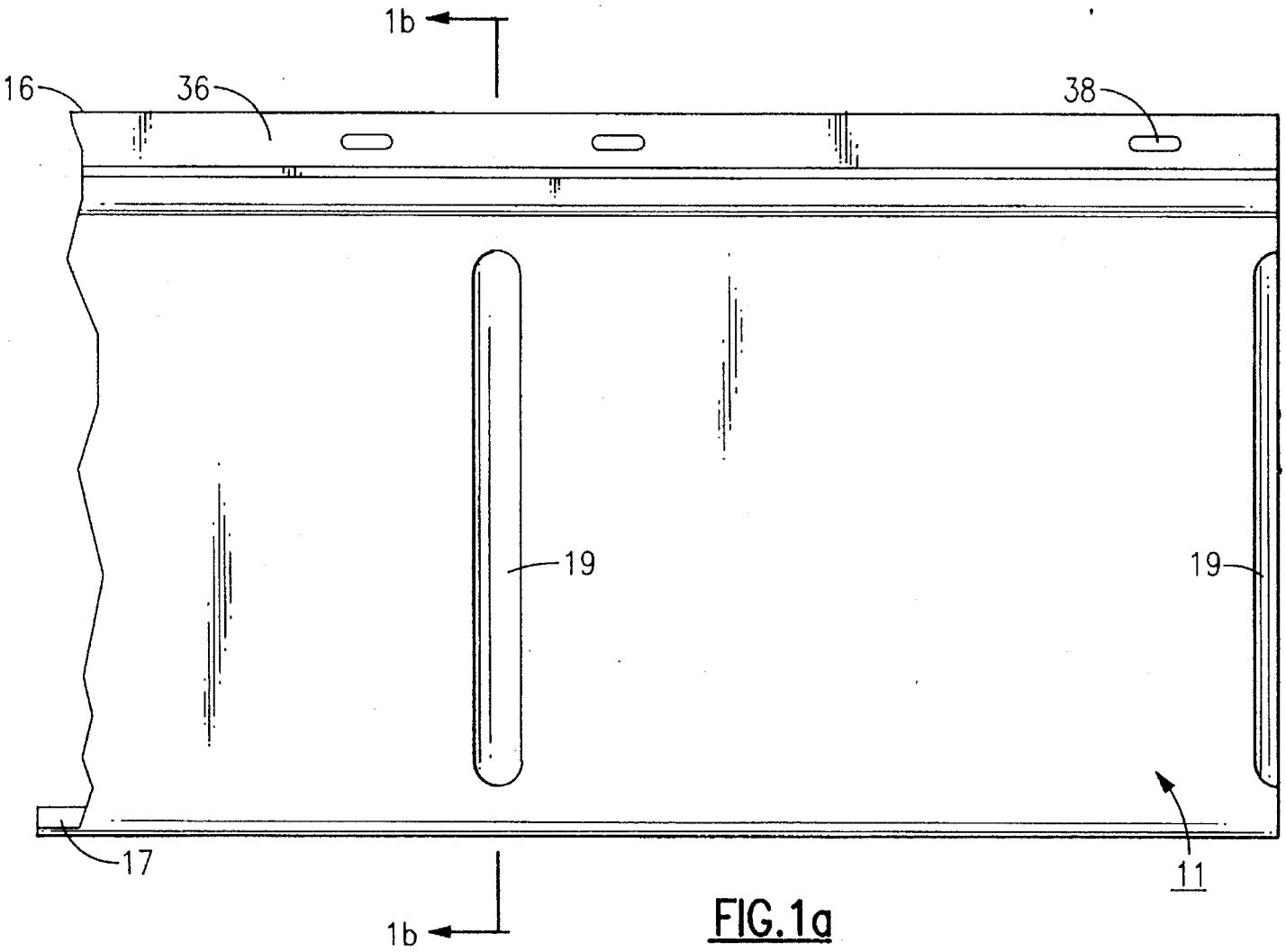
FIG. 1*a* is a fragmentary top view of one of the shingles used in the system of instant invention.
Figure 1B:
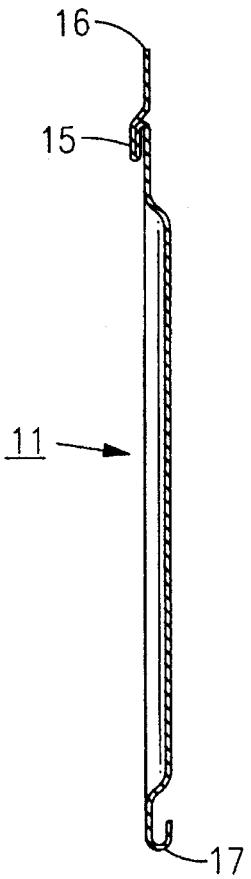
FIG. 1*b* is a cross-sectional view of the shingle of FIG. 1 taken along line 1*b*—1*b*.

As is shown in FIG. 1*a*, each metal shingle 11 is doubled back on itself twice (an s-bend) near the upper edge to produce an upper locking flange 15, as best seen in FIG. 1*b*, measuring ⅝ inches and spaced one inch below the upper horizontal edge 16 of the metal shingle 11, creating a one inch securement border 36. Each metal shingle 11 is also doubled back on itself once at the bottom to create a lower locking flange 17 adjacent the lower edge of the metal shingle. Alternatively, the upper locking flange 15 may comprise a separate flange member that is secured, for example by welding, to the outer surface of the metal shingle 11 adjacent the upper edge 16 thereof. The upper locking flanges 15 of the metal shingles 11 in one of the horizontal courses of shingles engage and interlock with the locking flanges 17 of the metal shingles 11 in the horizontal course 10 directly thereabove in a manner well known in the art.

Each metal shingle 11 is formed with at least two, and usually three or more, vertically disposed depressed grooves 19 which extend from a point slightly above the lower locking flange 17 of the metal shingle 11 to a point slightly below the upper locking flange 15. One-half vertically disposed depressed groove 19 is located at the vertical edge 20, 20 at each end of each metal shingle 11 so that when the metal shingles 11 are assembled side by side within each horizontal row 10, the abutting end edges 20, 20 of the vertically adjacent metal shingles 11 together form a single groove 19 which groove 19 lies in close proximity to the underlying roofing substructure. Additionally, the depressed groove 19 formed by abutting end edges of adjoining metal shingles 11 strengthens and stiffens the metal shingles 11 so that the ends of the shingles 11 will not bow upwardly when subjected to high winds or other external forces.

Figure 2:
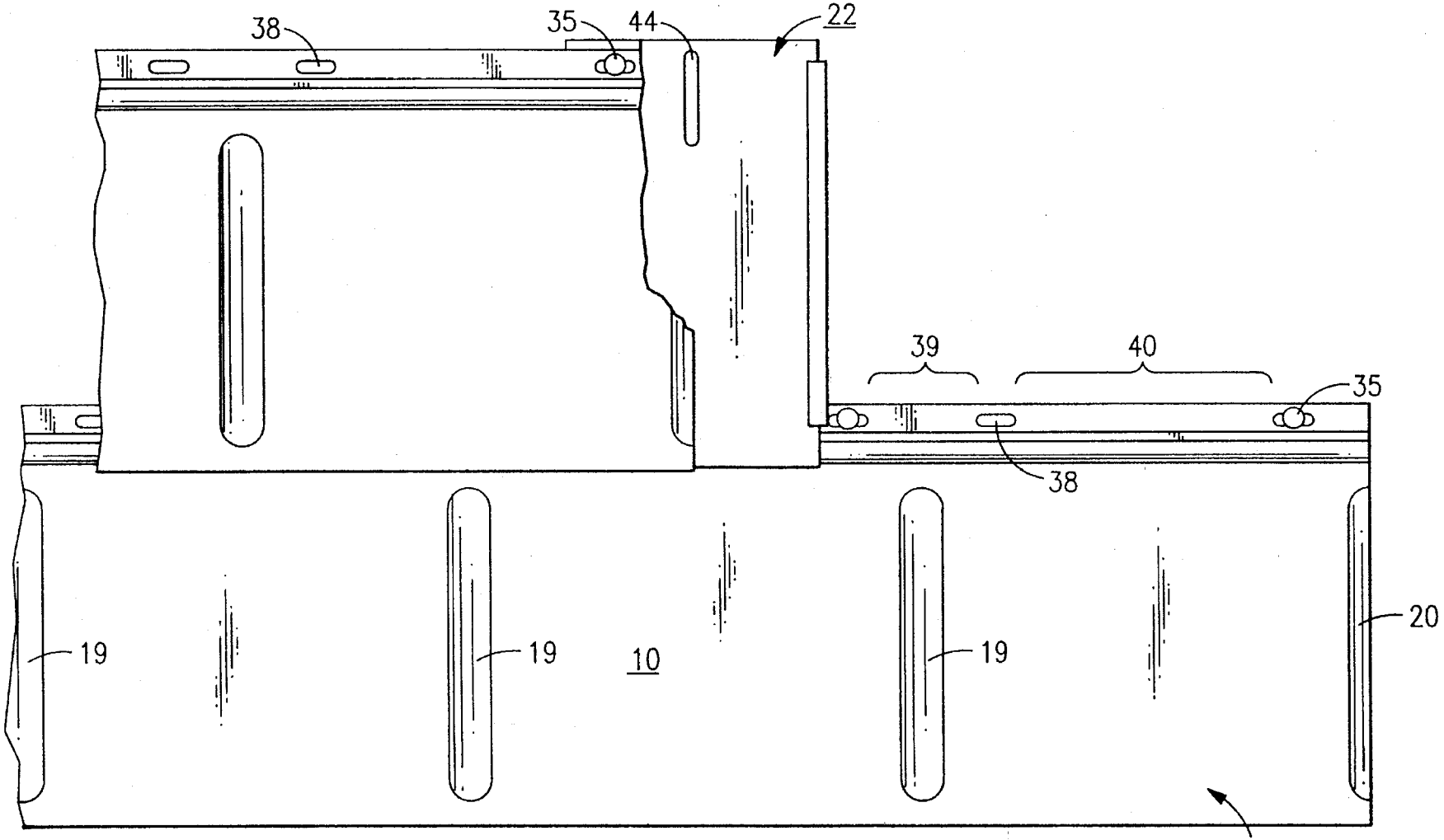
FIG. 2 is a top fragmentary view partly broken away of the roofing construction of the instant invention, showing the juncture of two panels and a joint pan.

The securement border 36 contains a series of horizontally oriented oblong fastener guides 38 cut or punched from the metal. These fastener guides 38 are each 13/16 inches long and ⅛ inch high and are set a first distance 39 apart of 3 and 9/16 inches (inner edge to inner edge) equidistant from and on either side of each groove 19, and a second distance 40 apart of 7 and 3/16 inches (inner edge to inner edge) equidistant from but not surrounding a groove. This relationship can be clearly seen in FIG. 2. The second distance spacing is approximately 1/16 inch wider than the width of the joint pan 22 as will be discussed hereinafter (That is the second distance is substantially equal to the width of the joint pan). This allows for alignment of the joint pan 22 and juxtaposed shingles 11 without the need for snapping a chalk line, measurement and marking, or like labor intensive methods as will be discussed hereinafter.

In addition, the width of each fastener guide 38 provides sufficient space about the copper roofing nails 35 so as to allow free expansion and contraction of the metal as may occur during temperature changes, without causing buckling or oil-canning. Furthermore, the presence of the fastener guides 38 encourages use of the optimal number of fasteners as well as the optimal placement thereof. It is preferable that for each run of eight fastener guides 38 in a shingle 11, five nails 35 be used. The extra fastener guides 38 are provided so that sufficient are available in the instances where guides correspond to an underlying void space that cannot or should not have a nail 35 driven therethrough.

Figure 4:
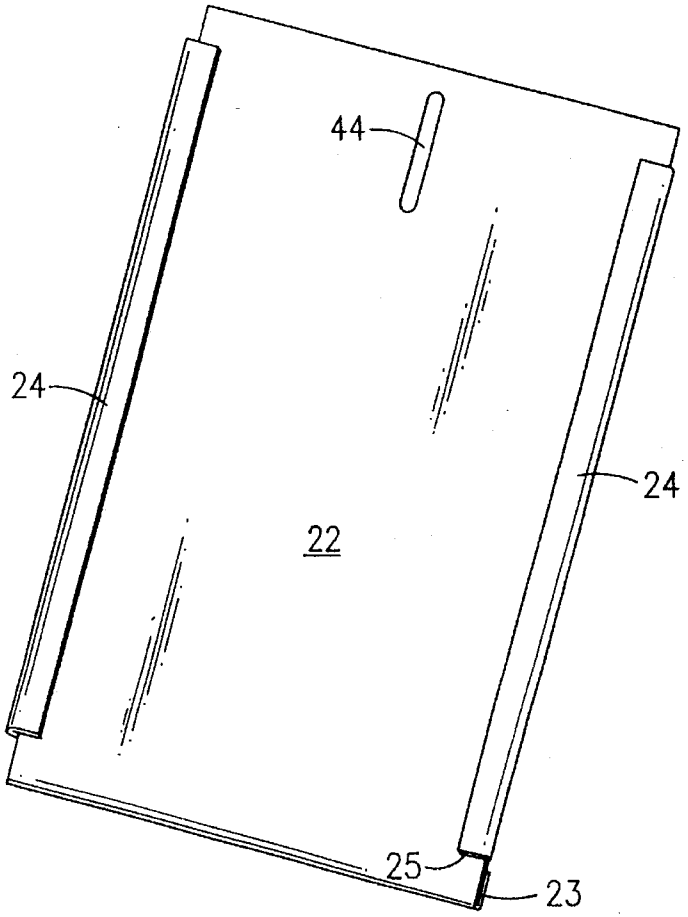
FIG. 4 is a perspective view of a joint pan of the instant invention.

The butt joint of the end edges 20, 20 of adjacent metal shingles 11, 11 is not, due to the possibility of leakage through the seam, weather-proof or water-tight. To provide a water-tight and weather-proof joint, a specially designed metal joint pan 22 is disposed directly beneath the abutting edges of adjoining metal shingles 11, 11. The metal joint pan 22 is provided with a locking flange 23 at the lower end edge thereof that is adapted to engage the upper locking flange 15 of a metal shingle 11 disposed directly therebeneath. This feature of the joint pan 22 construction is shown in FIG. 4 of the Drawing. A water seal lip member 24 is provided along each vertical edge of the joint pan 22, the lip members 24 being adapted not only to prevent rain water and the like from flowing onto the roofing substructure but also to contact and support the undersurface of the metal shingles 11 under which the joint pan 22 is disposed. The lower end 25 on each of the water seal lip members 24 terminates at a point located slightly above the locking flange 23 of the joint pan 22. The distance above the lower locking flange 23 at which the lip members 24 terminate, is equal to at least one-half, but not greater than the distance that the upper locking flange 15 of each metal shingle 11 is spaced below the upper edge 16 of said metal shingle. This distance is critical because the water seal lip members 24 must extend downwardly a sufficient distance to overhang the upper edge 16 of the metal shingle 11 disposed directly therebeneath, whereby rain water and the like collected by the joint pan 22 will be delivered onto the upper surface of that metal shingle 11. At the same time, the lip members 24 must not extend downwardly so far as to interfere with the engagement and interlocking of the lower locking flange 17 of the overlying metal shingle 11 with the upper locking flange 15 of the metal shingle positioned therebelow.

Each joint pan contains a centrally located vertically oriented ridge 44, which is used to align the placement of metals shingles 11 joined directly thereabove as will be hereinafter discussed, obviating the need for labor intensive alignment strategies.

The roofing construction of the instant invention is applied to a substantially planar roofing substructure by first nailing (using barbed copper nails 35) or otherwise affixing a metal starting strip 27 to the lower edge or eave 28 of the roof as shown in FIG. 5. In addition, V-shaped metal flashing 29 is applied to the trough-like joints formed where two pitched roof sections come together as also shown in FIG. 5. The metal shingles 11 and the metal joint pans 22 of the first or lowermost horizontal course **10*a* of the metal roofing are then applied to the planar roofing substructure by first aligning the metal joint pans 22 which are centered beneath the abutting short ends 20, 20 of metal shingles 11, 11, and engaging the locking flange 23 at the lower end thereof with the metal starting strip 27. Proper placement of the joint pans 22 is performed by aligning the short ends 20, 20 of the abutting metal shingles 11, 11 with the vertical ridge 44**, of the joint pan.

The metal shingles 11 of the lowermost course **10*a* are secured to the roofing substructure by first engaging the lower locking flange 17 of each metal shingle with the metal starting strip 27. Finally the tops of the first row of shingles 11 are secured by barbed copper nails 35 driven through fastener guides 38 in securement border 36. Barbed copper nails 35** will not rust out due to galvanic incompatibility and are resistant to being withdrawn from the underlying roofing structure.

Succeeding courses **10*b*, etc. of the roofing structure (that is, the second, course etc. from below) are next applied to the roofing substructure by first centering each joint pan 22 between pairs of fastener guides 38 of the preceding courses 10, set apart at second distance 40 intervals as previously described, followed by applying pairs of abutting metal shingles 11 of the current course, positioning the edges 20, 20 using the vertical ridges 44 on the joint pans 22 as guides. As noted, one of the joint pans 22 underlies each pair of butt joints of the adjoining metal shingles 11, 11 in each course, the locking flange 23 of the joint pan 22 and the lower locking flange 17 of the overlying metal shingles 11 overlapping and interlocking with the upper locking flange 15 of the metal shingle 11 positioned directly therebelow as shown best in FIG. 2. Finally the tops of each succeeding row of shingles 11 are secured by barbed nails 35 driven through fastener guides 38**.

Using this installation method, the metal shingles in adjacent courses (for example, course **10*a* and 10*b* etc.) are applied, as they should be, so that the butt joints of adjoining metal shingles 11, 11 of one course do not coincide with the butt joints of adjoining shingles 11, 11 of the adjacent course, but, rather, are staggered. In this manner the metal shingles 11 and the underlying joint pans 22** are applied to the roofing substructure in a plurality of vertically overlapping horizontal rows that, except for the junctions of two pitched roof sections hereinafter described, completely cover the roof with a weather-tight outer sheath of sheet metal.

Figure 3:
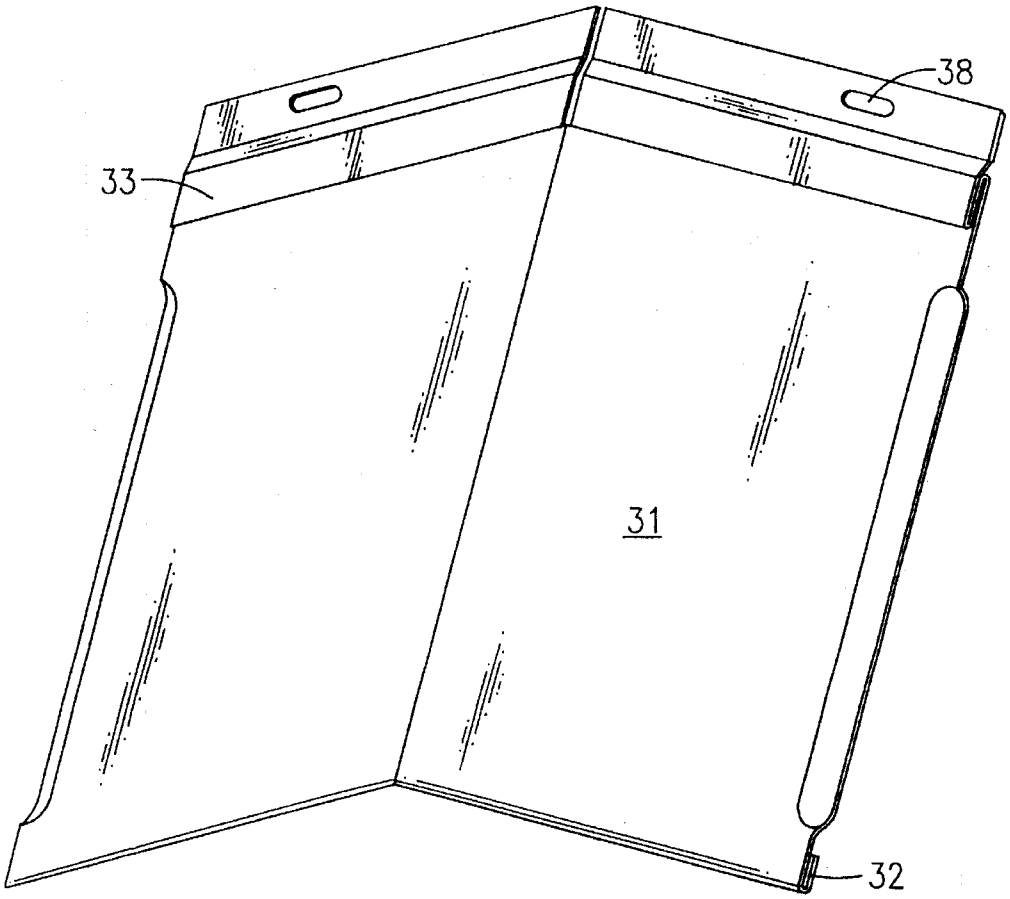
FIG. 3 is a perspective view of a ridge shingle of the instant invention.

Although the laying of a course of shingles 11 and joint pans 22 is described as if each step completely preceded the next for the course, it is apparent that each metal shingle 11 may be placed and fastened, together with the appropriate joint pan 22 before proceeding to place and fasten the next metal shingle 11 and joint pan 22.

Where two sections of pitched roof come together to form a hip/ridge-like juncture as shown in FIG. 5 the juncture is made weather-tight by trimming the edges 20 of the metal shingles 11 to conform to the hip/ridge line, followed by applying sheet metal hip/ridge cover members 31 over the joint to form a weather-tight assembly. As shown in FIG. 3, the metal ridge cover members 31 are provided with lower locking flanges 32 at the lower ends thereof and with upper locking flanges 33 at the upper ends thereof which interlock with the corresponding locking flanges of adjoining ridge cover members 31 in the manner known in the art.

While this invention has been explained with reference to the structure disclosed herein, it is not confined to the details set forth and this application is intended to cover any modifications and changes as may come within the scope of the following claims:

What is claimed is:

1. A metal roofing system comprising a plurality of overlapping horizontal courses of metal shingles secured to a roofing substructure, with said shingles being rectangular in shape having a long horizontal dimension defined by a top securement border and a lower locking flange and two short vertical edge each said course being formed from a horizontal row of metal shingles that abut each other on their short vertical edges and overlap and interlock with other metal shingles in a course disposed directly therebelow, said shingles further containing a plurality of fastener guides appropriately spaced along the securement border at a top of said shingles, a joint pan positioned below abutting metal shingles within each said course, said joint pan providing a water-tight and weatherproof joint, and a deformation at a top of each joint pan, said deformation functioning go jointly with said fastener guides to indicate proper placement for a short edge of a metal shingle.

2. The metal roofing system according to claim 1 wherein said fastener guides are adapted for driving fastening means therethrough and said fastener guides are located so as to ensure optimal use and placement of fastening means whereby maximal resistance to wind blow-off is achieved by the roofing system.

3. The metal roofing system according to claim 2 wherein said fastener guides are dimensioned to allow for expansion and contraction of said metal shingles.

4. The metal roofing system according to claim 3 wherein said fastener guides are oblong in shape.

5. The metal roofing system according to claim 2 wherein pairs of said fastener guides are spaced apart to accommodate a width dimension of a joint pan therebetween whereby said joint pan is aligned between said pair of said fastener guides.

6. The metal roofing system according to claim 1 wherein said shingles are fabricated of copper and said shingles are fastened to the roofing substructure with barbed copper nails.

7. A metal roofing system comprising:

a plurality of overlapping horizontal courses of metal shingles secured to a roofing substructure, with said shingles being rectangular in shape having a long horizontal dimension defined by a top securement border and a lower locking flange and two short vertical edges each said course being formed from a horizontal row of metal shingles that overlap and interlock with metal shingles in a course disposed directly therebelow, said shingles further containing a plurality of fastener guides appropriately spaced along a securement border at a top of said shingles, a joint pan positioned below abutting metal shingles within each said course, a deformation at a top of each joint pan, said deformation functioning cojointly with said fastener guides and indicating proper placement for a short edge of a metal shingle, said fastener guides being adapted for driving fastening means therethrough and said fastener guides being located so as to ensure optimal use and placement of fastening means whereby maximal resistance to wind blow-off is achieved by the roofing system, said fastener guides being oblong in shape and dimensioned to allow for expansion and contraction of said metal shingles, and pairs of said fastener guides spaced apart to accommodate a width dimension of a joint pan therebetween whereby said joint pan is aligned between said pair of said fastener guides; and said shingles fabricated of copper and said shingles fastened to the roofing substructure with barbed copper nails.

8. A method of installing a metal shingle roof which having a plurality of fastener guides comprising the steps of:

centering a joint pan between a pair of fastener guides spaced a predetermined distance apart, said distance being substantially equal to a width of said joint pan, said fastener guides being located on a top of a first metal shingle, said first metal shingle being located in a first row and said joint pan being located in a second row;

engaging a locking flange adjacent a lower edge of said joint pan with an upper locking flange of said first shingle;

aligning an edge of a second shingle with a centrally located vertically on ridge on a top portion of said joint pan, said second shingle being located in the second row;

engaging a lower locking flange of said second shingle with the upper locking flange of said first shingle;

aligning an edge of a third shingle against the edge of the second shingle, said third shingle being located in the second row; and engaging a lower locking flange of said third shingle with the upper locking flange of said first shingle; and fastening a top of said second shingle and a top of said third shingle to a roofing substructure by placing fasteners through said fastener guides.

* * * * *